US009783984B2

(12) United States Patent
Oleske

(10) Patent No.: US 9,783,984 B2
(45) Date of Patent: Oct. 10, 2017

(54) CEILING MOUNTING SYSTEM AND RELATED METHOD

(71) Applicant: ARMSTRONG WORLD INDUSTRIES, INC., Lancaster, PA (US)

(72) Inventor: Peter J. Oleske, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 14/728,404

(22) Filed: Jun. 2, 2015

(65) Prior Publication Data

US 2016/0356041 A1 Dec. 8, 2016

(51) Int. Cl.

| | |
|---|---|
| ***E04B 9/22*** | (2006.01) |
| ***E04B 9/04*** | (2006.01) |
| ***E04B 9/06*** | (2006.01) |

(52) U.S. Cl.

CPC ..... *E04B 9/225* (2013.01); *E04B 9/0442* (2013.01); *E04B 9/067* (2013.01); *E04B 9/0464* (2013.01)

(58) Field of Classification Search

CPC ..... E04B 9/0442; E04B 9/225; E04B 9/067
See application file for complete search history.

(56) References Cited

U.S. PATENT DOCUMENTS

| | | | | |
|---|---|---|---|---|
| 3,095,943 | A * | 7/1963 | Kemp | E04B 9/001 181/292 |
| 3,400,506 | A | 9/1968 | Thompson | |
| 4,463,537 | A | 8/1984 | Rodriquez et al. | |
| 5,140,913 | A * | 8/1992 | Takeichi | B61D 17/04 105/396 |
| 6,904,730 | B2 | 6/2005 | Mitchell | |
| 7,841,149 | B2 | 11/2010 | Jahn et al. | |
| 8,051,618 | B2 | 11/2011 | Ahren et al. | |

(Continued)

FOREIGN PATENT DOCUMENTS

| | | |
|---|---|---|
| CH | 525348 | 7/1972 |
| CN | 201507056 | 6/2010 |

(Continued)

OTHER PUBLICATIONS

International Search Report for corresponding Application No. PCT/US2016/035166, mailed Sep. 9, 2016. WO.

*Primary Examiner* — Patrick J Maestri
(74) *Attorney, Agent, or Firm* — Craig M. Sterner

(57) ABSTRACT

A ceiling system comprises a pair of spaced overhead longitudinal grid support members and a light-weight ceiling panel suspended therefrom. The panel may be an acoustical honeycomb panel in one embodiment. Localized elongated reinforced areas or sections are formed on the top facing which support a plurality of hangers mounted on each section. The reinforced sections coincide in arrangement with the layout of the support members and structurally strengthen the top facing in select areas. In one embodiment, each reinforced section may comprise a stiffening spline attached to the top facing. The ceiling panel is hung from the grid support members via the hangers and reinforced sections. Fasteners may be used to attach the hangers to the reinforced sections which resist pullout when the panel is hung. In certain embodiments, the reinforced sections extend longitudinally through a central portion of the panel to prevent sagging between the panel sides.

20 Claims, 7 Drawing Sheets

(56) References Cited

U.S. PATENT DOCUMENTS

| | | | | |
|---|---|---|---|---|
| 8,596,008 | B2 | 12/2013 | Waters et al. | |
| 8,596,009 | B2 * | 12/2013 | Baxter | E04B 9/225 52/220.6 |
| 2006/0005495 | A1 | 1/2006 | Stessel et al. | |
| 2009/0000248 | A1 * | 1/2009 | Waters | E04B 9/0464 52/800.1 |
| 2014/0245687 | A1 | 9/2014 | Grandi | |

FOREIGN PATENT DOCUMENTS

| | | |
|---|---|---|
| DE | 10110533 | 9/2002 |
| EP | 1191162 | 3/2002 |
| JP | 2000336830 | 12/2000 |
| WO | 2012061269 | 5/2012 |
| WO | 2013045846 | 4/2013 |

* cited by examiner

CEILING MOUNTING SYSTEM AND RELATED METHOD

BACKGROUND

The present invention relates to suspended ceiling systems with concealed support grids.

Many types of suspended ceiling systems and methods for mounting ceiling panels have been used. One type of system uses a suspended metal support grid including an array of orthogonally intersecting grid support members for mounting ceiling panels.

Honeycomb ceiling panels are one example of a light-weight acoustical panel (e.g. less than 0.5 lbs./ft.$^2$) having sound absorption properties that may be supported by such a support grid. The panels generally comprise a top facing sheet, bottom facing sheet, and a core disposed therebetween comprised of an open cell matrix. The top and bottom facing sheets are often formed of paper or a similarly thin material or scrim.

Although honeycomb panels are relatively stiff, the central portion of the panels between the peripheral edges has a tendency to sag (i.e. "pillow") if the unsupported span of the panel becomes too large. This creates a wavy and undesirable visual appearance for the ceiling system. Regrettably, the construction of honeycomb panels with thin top facing sheet is not amenable to direct attachment of the mounting hardware to the central portion to eliminate the sagging issue. There is insufficient strength and purchase (i.e. thickness) of the top facing to accept and retain threaded fasteners without pullout.

Accordingly, the usual approach heretofore has been to provide perimeter support for honeycomb panels at only their peripheral edges by placing the grid support members close enough together to engage the panels in a manner that prevents excessive sagging in the central portion of the panel. This unfortunately limits the practical size of honeycomb panels that can used with a conventional support grid and panel mounting system, thereby resulting in an increased number of visible seams. Furthermore, the inability to support the honeycomb panel from the central portion of the top facing (i.e. rear or back side facing the plenum area above the panels) also makes it difficult to use honeycomb panels in a concealed ceiling system which hides the support grid from room occupants below.

Accordingly, an improved system and method for supporting large format honeycomb ceiling panels for use in a concealed ceiling system is desired.

SUMMARY

A ceiling system according to the present disclosure provides light-weight large format acoustical honeycomb ceiling panels dimensionally exceeding the spacing of the overhead grid support members. Advantageously, each large format honeycomb ceiling panel may therefore replace the use of several smaller panels to cover an equivalent ceiling area as used in prior honeycomb ceiling systems, thereby minimizing visible seams. The mounting system disclosed herein allows support of these large format ceiling panels in a manner that conceals the ceiling support grid. The mounting system also advantageously supports the central portion of the honeycomb panels, thereby preventing sagging even with large format panels and reducing the number of grid support members required (e.g. main beam runners and cross tees). This advantageously creates a desirable visual and concomitantly reduces installation and capital costs for the ceiling system.

In one aspect, a ceiling system includes: an overhead support grid including an elongated longitudinal grid support member; a ceiling panel disposed below the support grid and supported by the grid support members, the ceiling panel including a top facing sheet, a bottom facing sheet, a core extending between the top and bottom facing sheets, and a plurality of peripheral sides; the top facing sheet including a longitudinally extending first reinforced section structured to have a greater stiffness than unreinforced portions of the top facing sheet; and a plurality of hangers attached to the first reinforced section of the top facing sheet, the hangers being configured for removable attachment to the longitudinal grid support member; wherein the ceiling panel is hung from the longitudinal grid support members via the hangers and conceals the grid support member when viewed from below the bottom facing sheet. In one embodiment, the first reinforced section may be a raised stiffening spline attached to the top facing sheet.

In another aspect, a ceiling system includes: a longitudinal axis; a pair of elongated longitudinal grid support members arranged parallel to the longitudinal axis; at least one elongated lateral grid support members arranged transversely between the longitudinal grid support members; a ceiling panel supported by the longitudinal grid support members, the ceiling panel each including a top facing sheet, a bottom facing sheet, a honeycomb core extending between the top and bottom facing sheets, a plurality of peripheral sides, and a central portion disposed between the peripheral sides; the top facing sheet including first and second longitudinally extending reinforced sections structured to have a greater rigidity than unreinforced portions of the top facing sheet, the reinforced sections extending through the central portion of the ceiling panel; and a plurality of hangers attached to each of the first and second reinforced sections of the top facing sheet, the hangers being configured for removable attachment to the grid support members; wherein the ceiling panel is hung from the longitudinal grid support members via the hangers and conceals the grid support member when viewed from below the bottom facing sheet.

A method for supporting ceiling panels in a ceiling system is provided. The method includes: providing an overhead support grid including a pair of laterally spaced longitudinal grid support members; providing a ceiling panel comprising a top facing sheet, a bottom facing sheet, a honeycomb core extending between the top and bottom facing sheets, a plurality of peripheral sides, and a central portion extending between the peripheral sides; forming a pair of laterally spaced apart elongated reinforced sections on the top facing sheet, the reinforced sections extending longitudinally through the central portion of the ceiling panel and structured to have a greater rigidity than unreinforced portions of the top facing sheet; mounting a plurality of hangers on each of the reinforced sections of the top facing sheet, the hangers spaced apart and forming a longitudinal row of hangers on each reinforced section; positioning the ceiling panel beneath the longitudinal grid support members; raising the ceiling panel with mounted hangers towards the overhead support grid; and attaching the hangers in each row to a respective one of longitudinal grid support members, wherein the ceiling panel is suspended from the overhead support grid by the hangers.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
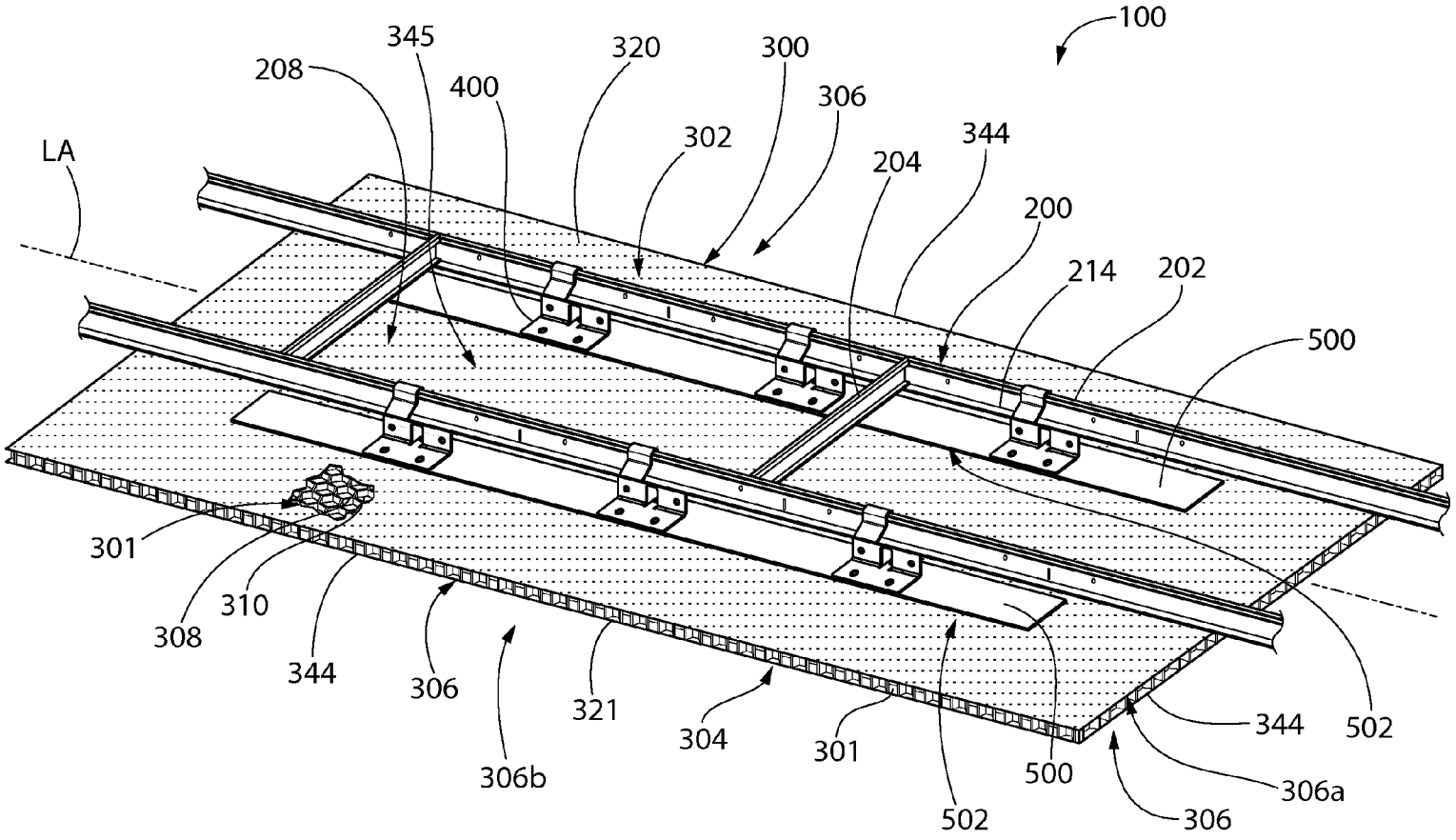
FIG. 1 is a top perspective view of a ceiling and panel mounting system comprising a support grid formed by grid support members and a ceiling panels.

All drawings are schematic and not necessarily to scale. Parts given a reference numerical designation in one figure may be considered to be the same parts where they appear in other figures without a numerical designation for brevity unless specifically labeled with a different part number and/or described herein.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
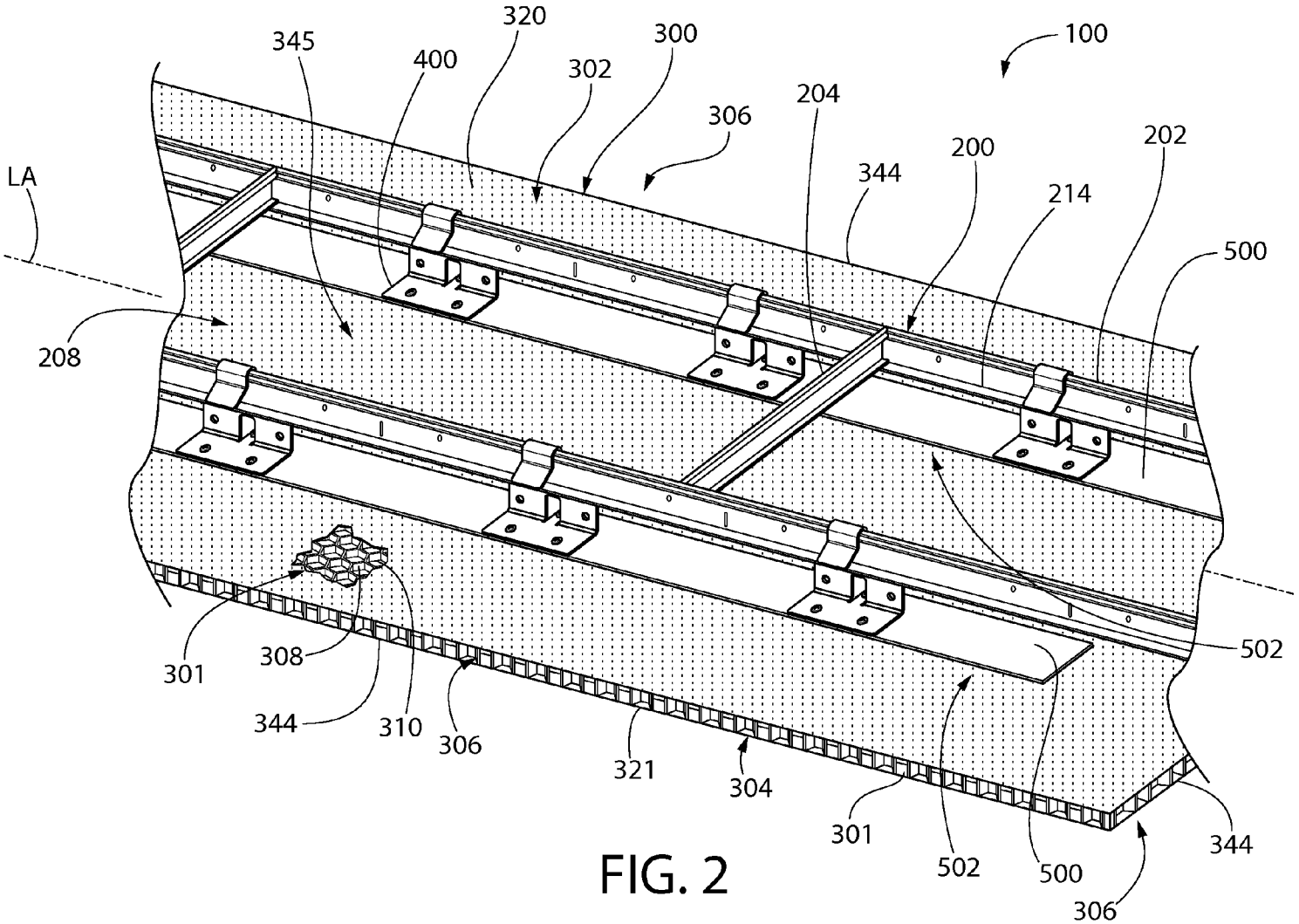
FIG. 2 is an enlarged view of a portion of the ceiling and panel mounting system from FIG. 1.

FIGS. 1-2 depict an exemplary embodiment of a ceiling system 100 according to the present disclosure. The ceiling system 100 generally includes an overhead support grid 200, ceiling panels 300 supported by the grid support members, and panel hangers 400 which support the panels from the grid. In one embodiment, the ceiling panels 300 may be configured, dimensioned, and mounted to the support grid 200 in a manner that conceals the bottom facing grid face to form a monolithic ceiling appearance. Ceiling panels 300 may therefore be arranged with abutting peripheral edges to form the monolithic ceiling which hides the grid face from the occupied building space below, as further described herein.

Referring to FIGS. 1-2, the overhead support grid 200 is configured for mounting from an overhead building support structure in a suspended manner via appropriate suspension elements, such as for example without limitation fasteners, hangers, wires, cables, rods, struts, etc. In one non-limiting exemplary embodiment, support grid 200 includes a plurality intersecting longitudinal grid support members 202 and lateral grid support members 204. Longitudinal and lateral grid support members 202, 204 are elongated in shape having a length greater than their respective width (e.g. at least twice), and in various embodiments lengths substantially greater than their widths (e.g. 3 times or more). Longitudinal grid support member 202 may have a substantially greater length than lateral grid support member 204 and form "main beams" or "runners" which are maintained in a substantially parallel spaced apart relationship by the lateral grid support members. The lateral grid support members 204 may be attached to and between adjacent (but spaced apart) longitudinal grid support members 202 at appropriate intervals using any suitable permanent or detachable coupling means. The combination of interconnected longitudinal and lateral grid support members 202, 204 provides strength and lateral stability to the support grid 200. In some installations, only the longitudinal grid support members 202 may be mounted to the overhead support structure via suspension elements while the lateral grid support members 204 may be supported solely by adjoining longitudinal grid support members at each end.

It bears noting that the lateral grid support members 204 are not required to mount the illustrated embodiment of the ceiling panels 300 which may be supported from the support grid 200 via only the longitudinal grid support members 202. Instead, a fewer number of lateral grid support members 204 may be provided than normally where some panels are supported by both the longitudinal and lateral grid support members. The lateral grid support members 204 used in the present system simply provide lateral stability to and maintain spacing between the longitudinal grid support members. In certain embodiments, the support grid 200 may comprise only longitudinal grid support members 202.

In one embodiment, grid support members 202 and 204 may be horizontally oriented when installed. It will be appreciated, however, that other suitable mounted orientations of grid support members 202, 204 such as angled or sloped (i.e. between 0 and 90 degrees to horizontal) may be used. Accordingly, although support members 202, 204 may be described in one exemplary orientation herein as horizontal, the invention is not limited to this orientation alone and other orientations may be used.

Longitudinal and lateral grid support members 202, 204 intersect to form an array of grid openings 208 which become essentially concealed by ceiling panels 300 to hide the building superstructure and utilities above the support grid 200. In some embodiments, the grid support members 202, 204 may be arranged in an orthogonal pattern wherein the support members intersect at right angles to form rectilinear grid openings 208 such as squares or rectangles (in top plan view). The terminal ends of the lateral grid support members 204 may be configured for permanent or detachable connection to the longitudinal grid support members 202 at right angles to form a rectilinear grid pattern using any suitable means. Non-limiting examples of suitable connection means include welding, soldering, clips, brackets, threaded fasteners, interlocking tabs/slots, etc. Accordingly, the present invention is not limited by the manner of attachment used.

Figure 3:
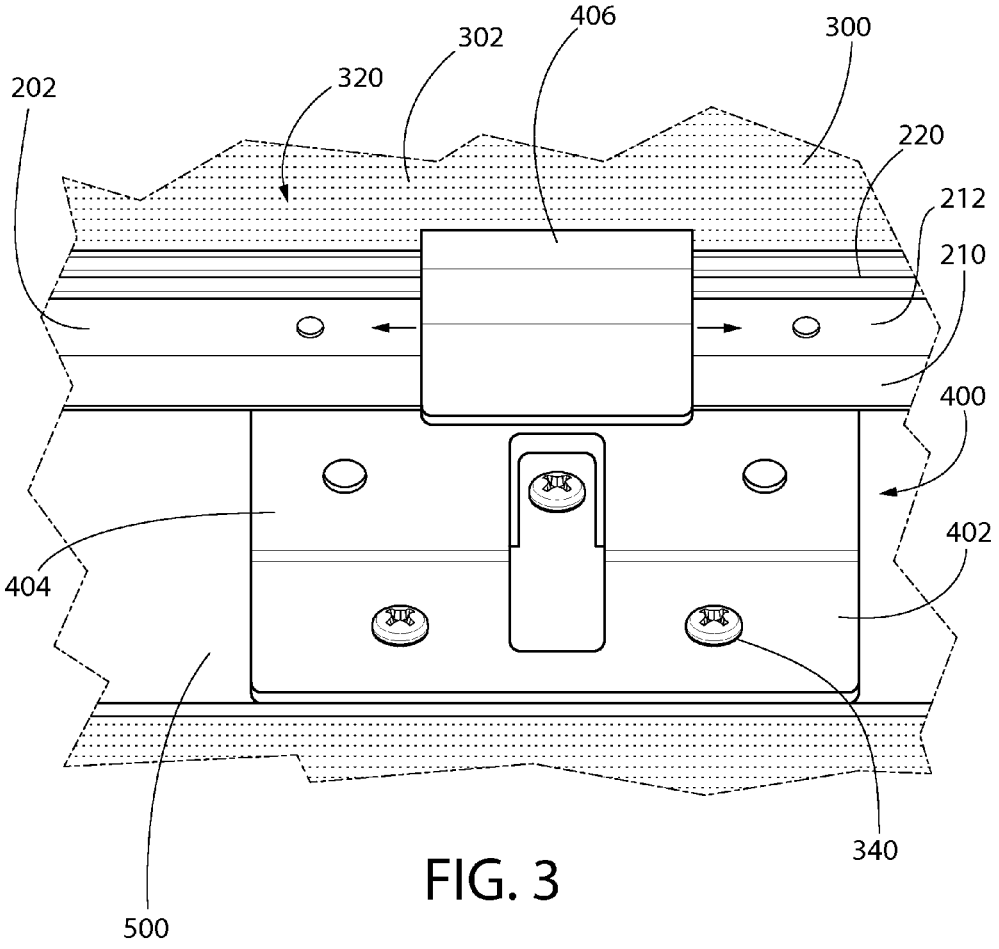
FIG. 3 is top perspective view of a hanger and reinforced section on the top facing sheet that mounts the ceiling panel to one of the grid support members.
Figure 4:
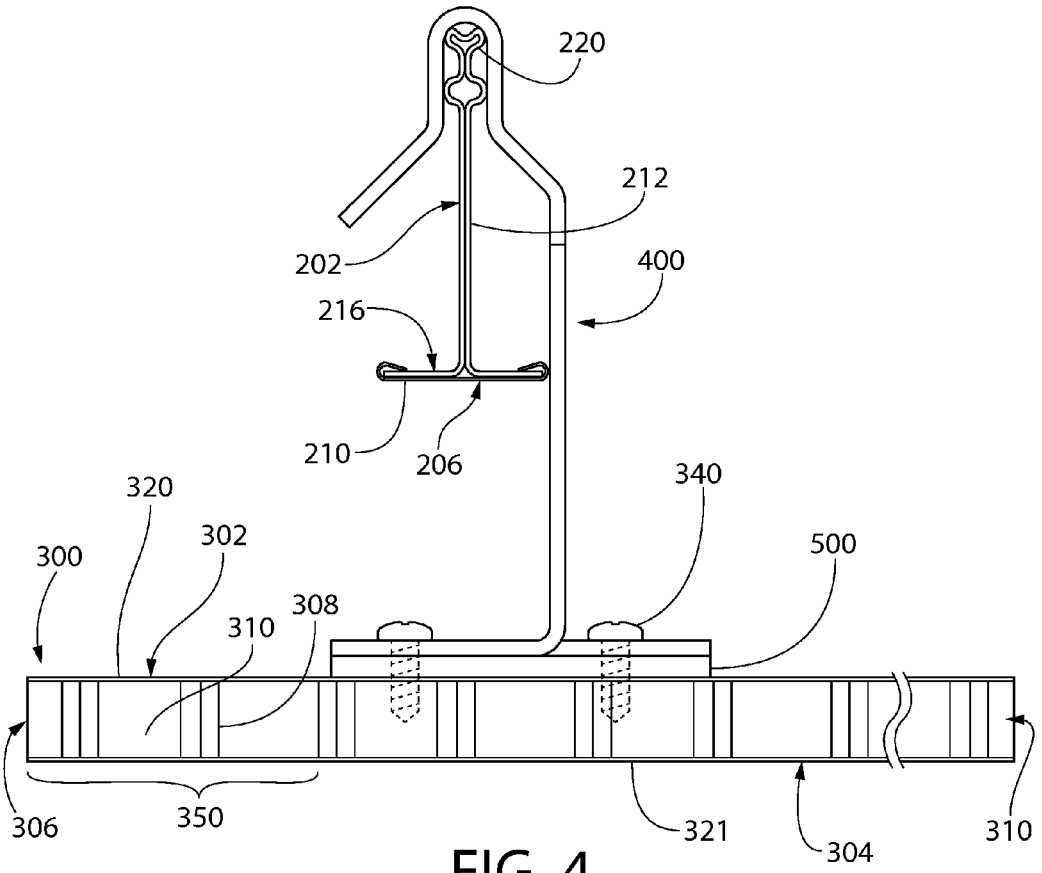
FIG. 4 is an end elevation view of one of the grid support members with ceiling panel suspended therefrom via a hanger.
Figure 5:
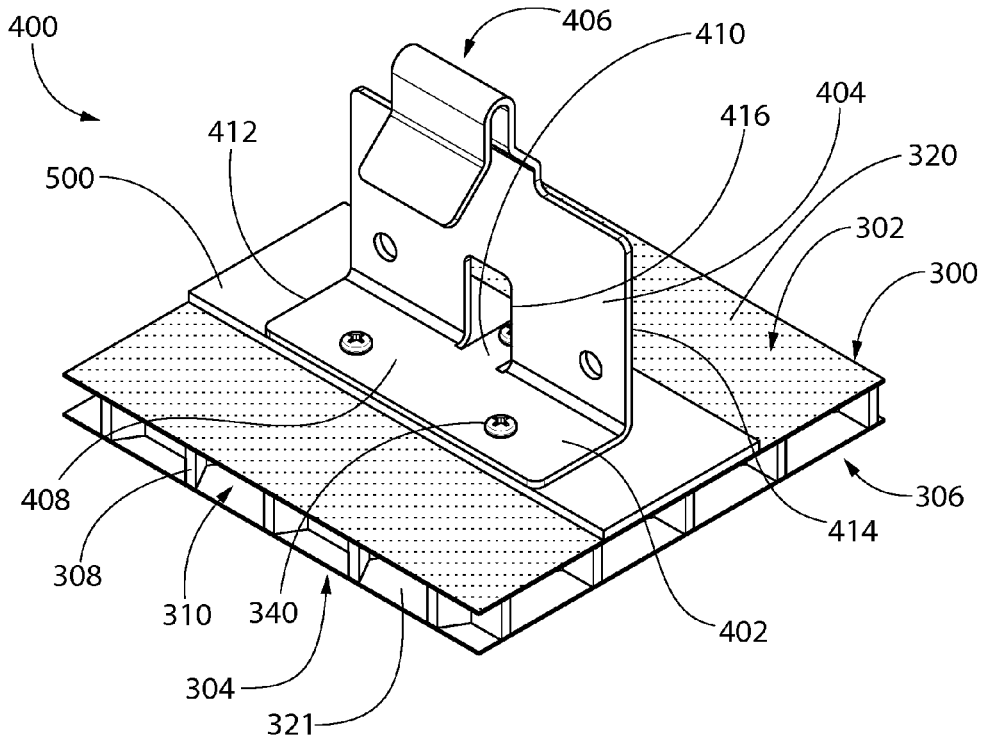
FIG. 5 is a top perspective view of a portion of the ceiling panel and mounting system.
Figure 6:
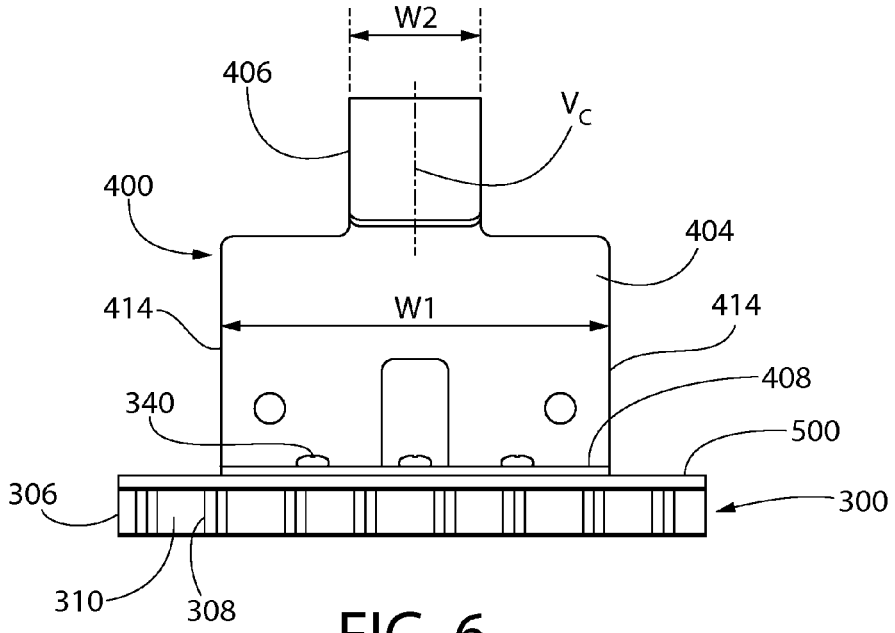
FIG. 6 is a side elevation view thereof.
Figure 7:
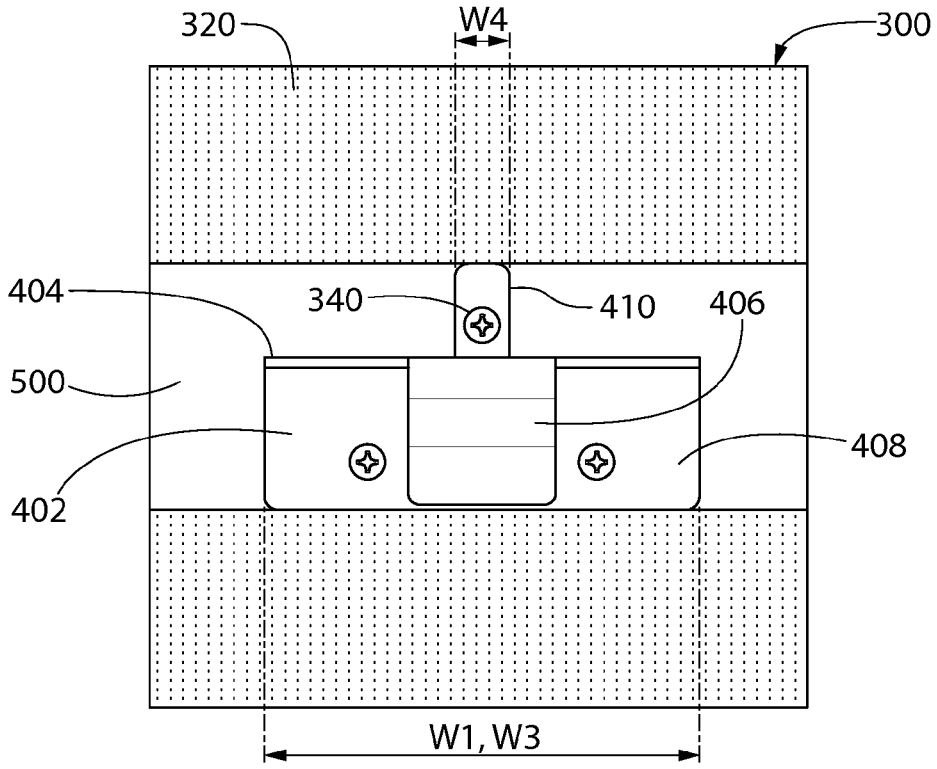
FIG. 7 is top plan view thereof.
Figure 8:
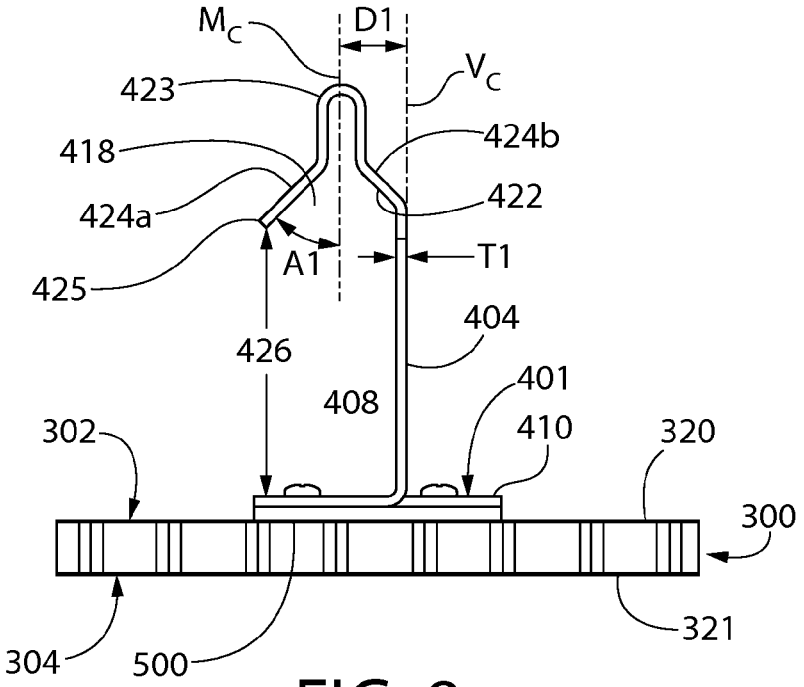
FIG. 8 is an end elevation view thereof.

With continuing reference to FIGS. 1-3, grid support members 202, 204 may be generally T-shaped (e.g. T-rails) in transverse cross section which provides structural stability. The grid support members have an inverted T-shaped configuration in an installed position when suspended from an overhead building ceiling support structure. Grid support members 202, 204 may each include a longitudinally-extending horizontal bottom flange 210, an enlarged top stiffening element 220 for increased structural stiffness, and a vertical web 212 extending upwards from the flange to the stiffening channel. In certain embodiments for lighter-duty service, however, the top stiffening channel 220 may be omitted completely from grid support members 202 and/or 204 such that the top of the vertical web 212 forms the upper terminal end of the grid support members 202, 204. Accordingly, the invention is not limited to either of the foregoing constructions and numerous variations of top stiffening elements 220 are possible.

The longitudinal and lateral grid support members 202, 204 define a longitudinal axis LA of the ceiling system and axial direction; the lateral grid support members 204 being arranged transversely thereto. Bottom flange 210 is substantially horizontally oriented when in an installed position in the embodiment shown (see, e.g. FIGS. 1 and 2) and has opposing portions which extend laterally outwards from web 212 and terminate in opposed axially extending longitudinal edges 214. Web 212 may be centered between the edges 214 and aligned with the vertical centerline of the grid support member in some embodiments. In other embodiments, the web 212 may be laterally offset from centerline of the grid support member 202 or 204.

Referring to FIGS. 1-4, the bottom flanges 210 of grid support members 202, 204 each includes a downward facing bottom surface 206 that defines the grid face typically visible from the occupied room or space below the support grid 200. Bottom surface 206 defines a horizontal ceiling reference plane for the overhead support grid 200. Flange 210 further defines an upward facing top surface 216. Longitudinal grid support members 202 may be configured similarly or the same as lateral grid support members 204, or each may be different in configuration. Regardless of the configurations used for grid support members 202 and, 204, each includes bottom flanges 210 and downward facing flange surfaces 206 which preferably lie in the same horizontal plane in one embodiment when hung from an overhead support structure of the building. In one embodiment shown in FIG. 1, the enlarged top stiffening channel 220 may be omitted from lateral grid support members 204 to facilitate mounting to the web 201 of the longitudinal grid support members 202. Furthermore, the terminal end portions of the bottom flanges 201 of lateral grid support members 204 may further be omitted when fabricated or notched/cut off in the field to also facilitate flush mounting of the flanges between the longitudinal and lateral grid support members 202, 204.

Grid support members 202 may be made of any suitable metallic or non-metallic materials structured to support the dead weight or load of ceiling panels 300 without undue deflection. In some non-limiting embodiments, the grid support members may be made of metal including aluminum, titanium, steel, or other. In some non-limiting embodiments, the grid support members 202 may be a standard heavy duty 15/16 inch aluminum T-rail having a 15/16 inch grid face or 9/16 inch T-rail having a narrow 9/16 inch grid face.

The large format grid-concealment ceiling panels 300 will now be described in further detail. Referring to FIGS. 1-3, ceiling panels 300 may have a generally flattened body with a substantially greater horizontal width and length than vertical thickness as shown. Ceiling panel 300 includes a top surface 302, opposing bottom surface 304, and peripheral sides 306 extending therebetween along the perimeter of the ceiling panel. In one embodiment, the peripheral sides 306 may be comprised of a pair of opposing longitudinal peripheral sides **306*a* and a pair of opposing lateral peripheral sides 306*b*. Top and bottom surfaces 302, 304 may be generally planar and arranged substantially parallel to each other in one non-limiting embodiment. The top and bottom surfaces 302, 304 are substantially greater in width and/or length than the height of the peripheral sides 306**.

Peripheral sides 306 define peripheral edges 344 which may have numerous possible configurations including flat (i.e. vertical), stepped, angled, or various combinations thereof and other shapes. In one embodiment, the ceiling panels 300 may have flat sides 306 and edges 344 configured to form a tightly abutting relationship and seams with adjoining ceiling panels 300. In some embodiments, the seams between panels 300 may be taped, spackled, and/or painted for better concealment as desired and needed.

In an exemplary embodiment, ceiling panels 300 may be light-weight acoustical honeycomb panels having an inner core 301 comprising a honeycomb structure formed from a plurality of interconnected cell walls 308 that define a plurality of open cells 310 (best shown in FIG. 2. The cell walls 308 are oriented perpendicular to the top and bottom surfaces 302, 304 of the ceiling panels 300 and extend vertically between the top and bottom surfaces. Any suitable shape of cells 310 (in top plan view) may be used, including hexagon, triangular, square, circular, etc. as some non-limiting examples.

In one embodiment, the core 301 may be formed by paper cell walls 308. Paper used to construct cell walls 308 may be at least 20 pound kraft paper, and in some embodiments 20 to 80 pound kraft paper (thicknesses of about 0.004 to 0.015 inches) which generally provides the requisite stiffness to the core to resist sagging of the ceiling panel without unduly adding weight to the ceiling panel structure. The paper may be resin-impregnated in some embodiments. In other possible embodiments, lightweight non-paper material such as fiberglass, plastic, and thin aluminum metal sheet also may perform satisfactorily for cell walls and be used.

With continuing reference to FIGS. 1-3, ceiling panel 300 may further include a top facing sheet 320 and bottom facing sheet 321 which define the top and bottom surfaces 302, 304 respectively. The facing sheets 320, 321 may be thin and substantially flat, and directly or indirectly coupled to the core 310 thereby forming an integral part of the ceiling panel structure. The facing sheet 320 may be permanently bonded to core 301 using a suitable industrial adhesive which is applied to the exposed upper edges of the core cell walls 308, thereby closing the upper ends of the cells 310. Industrial adhesives which may be used include Swift®tak from H.B. Fuller Company and others. The combination of core 301 and the top and bottom facing sheets 320, 321 collectively form a relatively rigid composite structure which resists sagging when installed in the support grid 200. The facing sheets 320, 321 may be made of any suitable thin material, including without limitation paper, resin impregnated paper, fiberglass, vinyl film, glass matte, vinyl treated paper, woven scrim, non-woven scrim including glass scrim or other materials, etc.

Ceiling panels 300 are large format panels having a length (measured along the longitudinal axis LA of the longitudinal grid support members 202) and a width (measured transversely to the longitudinal axis LA of the longitudinal grid support members 202). In some implementations, the ceiling panels may be at least 4 foot in width and 4 foot, 8 foot, 12 foot, or more in length. As best shown in FIGS. 1 and 2, the ceiling panels 300 may have a greater width than the lateral/horizontal spacing between the pair of longitudinal grid support members 202 used to mount each panel to the ceiling system 100. This is because the panel mounting system of the present invention supports the central portion 345 of the panel so sagging between the peripheral edges 344 in the lateral direction (transverse to longitudinal axis LA) is less of an issue. Accordingly, the ceiling panels in certain embodiments have opposing lateral cantilevered portions 350 each of which may extend substantially beyond a respective nearest of the grid support members 202 by at least 15% of the width of the panel or more in some arrangements (see, e.g. FIG. 4). For example, for ceiling panels 300 having a 4 foot width, the lateral cantilevered portions 350 of the panels may extend about 7.2 inches or more beyond the respective longitudinal grid support member 202. The width of the cantilevered portion permissible is limited by the stiffness of the panel 300 and may selected in part to prevent excessive sagging at the lateral peripheral edges 344 which may adversely affect formation of straight seams between adjoining panels.

A mounting system including hardware useable to hang the large format honeycomb ceiling panels 300 from the support grid 200 will now be described. FIGS. 4-8 show details of the hangers 400 with only a relevant small portion of the overall large format ceiling panels (not the entire panel).

Referring to FIGS. 1-8, a plurality of panel hangers 400 is provided which are configured for mounting each ceiling panel 300 to the support grid 200. Hangers 400 are attached to the ceiling panels and may be configured for removable mounting to the grid support members 202 or 204 to provide ready access to utility disposed in the space above the ceiling panels and support grid. The hangers 400 are intended to remain attached to the panels in certain embodiments, thereby advantageously allowing the panels to be dismounted from the grid support members without the encumbrances of fasteners or other mounting elements. In certain embodiments, the hangers 400 may be removably mounted to only the longitudinal grid support members 202 as shown which is generally sufficient to support the weight of ceiling panels 300. Threaded fasteners 340 such as screws may be used to mount the hangers 400 to the panels; however, other removable mounting techniques may be used. Each hanger 400 may mounted to the ceiling panel using three fasteners 340 as shown in FIGS. 5-8 using flanges 408, 410. In certain embodiments, the hangers may be permanently mounted to the ceiling panels 300 such as via industrial adhesives or other means.

Referring now to FIGS. 3-8, each hanger 400 includes a substantially horizontal base section 402 configured for coupling to the top surface 302 of the ceiling panel 300, an upright vertical central section 404 extending upwards from the base section, and an inverted U-shaped hooked section 406 disposed on top of the vertical section configured for engaging a grid support member 202 or 204. Hanger 400 includes a vertical centerline Vc which is defined by the central section 404 and a vertical mounting centerline Mc which is defined by hooked section 406. The mounting centerline Mc of hooked portion 406 is laterally offset by a distance D1 from the vertical centerline Vc of hanger 400 defined by the central section 404.

The body of the hanger 400 including sections 402-406 may a unitary monolithic structure in one embodiment and formed from of relatively thin flat sheet metal such as aluminum or steel bent to the configuration shown. Accordingly, the base section 402, central section 404, and hooked section 406 are each integrally formed portions of the hanger body and each may have the same thickness T1. In other embodiments, the thicknesses of each or some of the sections may be different. Hangers 400 may have a substantially shorter axial length or width W1 than grid support members 202 and/or 204 and are axially slideable along the support members for positioning the ceiling panel 300.

Base section 402 may include a first lateral flange 408 and a second opposed lateral flange 410 each extending outwards from vertical section 404 in opposite directions, as shown. The flanges 408, 410 are configured for coupling to the ceiling panel 300 as further described herein. In one embodiment, flanges 408, 410 may be oriented perpendicular to central section 404. Flange 408 may have a width W3 (measured in the longitudinal or axial direction with respect to grid support members 202, 204) which is substantially coextensive with the width W1 of the vertical central section 404 of hanger 400. Flange 410 may have W4 which is less than width W3 of flange 408 and width W1 of central section 404. In one embodiment, flange 410 may be disposed at the midpoint between the longitudinal ends 412 of flange 408 and/or longitudinal ends 414 of the central section 404.

In certain embodiments, flange 410 may be formed from a portion of central section 404 of hanger 400 adjacent to base section 402 which is cut and bent to shape, thereby leaving a transverse window 416 in the central section as shown. The top surface 401 of flange 410 may be in the same horizontal plane as the top surface 403 of opposing flange 408.

Hooked portion 406 includes a downwardly open mounting cavity 418 configured (i.e. shaped and dimensioned) for engaging and receiving at least a portion of the top stiffening element 220 of grid support members 202, 204 therein to for mounting the hanger to the support grid 200. In the illustrated exemplary embodiment, cavity 418 may comprise a narrow upper engagement portion 420 and a wider lower entry portion 422 disposed below. Engagement portion 420 has a smaller lateral width than the entry portion 422 to securely engage the enlarged top stiffening element 220 of grid support members 202, 204. Engagement portion 420 has a lateral transverse width slightly greater than the transverse width of the grid support member top stiffening element 220 to securely engage and prevent or minimize rotation of the hanger 440 with respect to the support members for a stable mounting thereon.

In one embodiment, engagement portion 420 of hooked section 406 may be formed by a pair of opposing parallel spaced apart vertical sidewalls 421 joined together at the top by a convexly curved top wall 423. The outwardly flared entry portion 422 may be formed by a pair of obliquely angled walls 424*a*, 424*b* arranged to converge at the bottom of the engagement portion sidewalls 421 as shown. Walls 424*a*, 424*b* may be disposed at an angle A1 between 0-90 degrees to the vertical mounting centerline Mc and vertical centerline Vc of hanger 400. The bottom free edge 425 formed on the angled wall 424*a* which is spaced apart from and opposite central section 404 of hanger 400 is therefore flared outwards away from the hanger central section 404 to facilitate mounting the hanger on the grid support members 202, 204 and subsequent guide the top stiffening element 220 of the support members into the narrower engagement portion 420. The bottom free edge 425 of wall 424*a* is vertically spaced apart by a distance 426 from base section 402 and lateral flange 408 sufficient to insert the top stiffening element 220 and a portion of grid support members 202, 204 into the mounting cavity 418. Accordingly, distance 426 also describes a lateral opening 426*a* of the hanger 400. In one embodiment, distance 426 is greater than the height of longitudinal grid support member 202 to allow the grid support member to be inserted completely through the lateral opening 426*a* without substantially tilting the ceiling panel 300 and hanger 400 attached thereto. It should be noted that the remaining angled wall 424*b* of entry portion 422 has a bottom which adjoins the top of the central section 404 as shown.

The hanger 400 may have an asymmetrical shape in transverse cross section as shown with the hooked section 406 being laterally offset to one peripheral side or the other of the central section 404 in vertical alignment with one of the flanges lateral 408, 410. In the exemplary embodiment illustrated, hooked section 406 is vertically aligned with lateral flange 408.

In one embodiment, hooked section 406 has a width W2 which is less than the width W1 of the vertical central section 404. Hooked section 406 may be arranged on hanger 400 and centered at approximately at the midpoint between the vertical longitudinal edges 414 of central section 404 in some embodiments as illustrated. In other embodiments, hooked section 406 may be axially offset towards one or the other from of the longitudinal edges 414 and not centered on the central section 404.

According to an aspect of the invention, an improved method for supporting light-weight acoustical honeycomb ceiling panels is provided. Although relatively light and somewhat stiff in structure, large format honeycomb panels (e.g. 4 ft.×4 ft., 4 ft.×8 ft., etc.) are prone to sagging in the central portion if not properly supporting by the grid support members 202, 204. This localized sagging ("pillowing") in the central portion obviously creates an undesirable visual appearance. Heretofore, practically the only mounting option available has been to arrange the grid support members in relatively close proximity to support each honeycomb panel along all four edges in a manner that maintains a relatively flat and neat installed appearance. Using perimeter edge support, the panels tend to sag as the span of the unsupported central portion becomes larger. In addition, the grid support members which provide the panel edge support often remain visible making it virtually impossible to create a monolithic ceiling appearance.

The present invention advantageously provides a mounting system which supports the honeycomb panel 300 including the central portion 345 directly from the top facing sheet 320 (i.e. back side) and its surface 302 in lieu of the perimeter of the panel. The support grid 200 and mounting hardware including panel hangers 400 are positioned above the panel and remain invisible to the room occupants below. In one exemplary and non-limiting arrangement, the grid support members 202, 204 may be positioned above and spaced apart from the top surface 302 of the panels as shown in FIGS. 1-3.

To achieve such "in-board" honeycomb ceiling panel mounting in lieu of perimeter edge support as in the past, one or more localized elongated reinforced sections 502 are formed on the top facing sheet 320 and surface 302 of the panels 300 at areas intended to receive threaded mounting fasteners. The reinforced sections 502 have greater rigidity and mechanical strength than other portions or areas of the top facing sheet 320 to better engage the threaded fasteners and resist pullout. In one embodiment, the reinforced areas comprise less than the total surface area of the top surface 302 of the top facing sheet 320. By using the reinforced sections 502 to attach the panel hangers 400 to the honeycomb panels 300, the weight-related stresses can be distributed more uniformly throughout the honeycomb panel structure. This distribution of force allows the panel to remain flat and stable using in-board hardware mounting by avoiding any localized pillowing and uneven/wavy edges. The reinforced sections 502 and panel hanger mounting hardware system allows the panels to be positioned from below, adjusted in position, and hung using a standard grid system. The large size 4'×4', 4'×8' or greater and light weight (e.g. <0.5 lb./ft$^2$) of the honeycomb panels 300 advantageously make installation of a prefinished panel from below easy, minimizes the number of seams, and allows the panels to be positioned adjacent to one another. It is also possible to make the bottom facing sheet 321 (scrim face) slightly oversized to form concealment flanges (see e.g. FIG. 9 described herein) that to extend beyond the lateral peripheral sides 306*b* of the panel and allow the flanges to overlap an adjacent panel, thus eliminating the visual gap typically associated with grid mounted ceiling systems.

The reinforced sections 502 are spaced laterally apart by a distance that approximately matches (but not necessarily exactly) the spread of the longitudinal grid support members 202 so as to position at least a portion of the reinforced sections below the grid support members when the ceiling panel 300 is mounted to the support grid 200. Because the position of the hangers 400 on the top facing sheet 320 is tied to the lateral spacing of the reinforced sections 502, this ensures that the hangers are each positioned to engage the longitudinal grid support members 202 when the ceiling panel 300 is hung from the support grid. The exact lateral positioning of the reinforced sections 502 will depend on the size and configuration of the panel hangers 400 so that the hangers may be hung from the grid support members 202 when mounted on the ceiling panels 300. The reinforced sections 502 preferably have a lateral width (measured transversely to the longitudinal axis LA that is at least as wide or larger than the lateral width of the horizontal base section 402 of the hanger 400 (see, e.g. FIGS. 4, 7 and 8) to properly support the hanger base. As shown in FIG. 1, the opposing longitudinal ends of the reinforced sections need not extend all the way to the longitudinal peripheral sides 306*a* of the ceiling panel in some embodiments to adequately support the central portion 345 of the panels. Accordingly, the ends of the reinforced section 502 may be spaced inwards from the longitudinal peripheral sides 306*a* of the panel. In other embodiments, the ends of the reinforced section 502 may extend all the way to meet the longitudinal peripheral sides of the panel.

Referring now to FIGS. 1-8, in one embodiment each reinforced section 502 may be configured as an elongated strip-like stiffening plate or spline 500 which is attached to the top facing sheet 320 sheet. The stiffening splines 500 have a longitudinally (axially) elongated and flattened structure in one embodiment having a longer axial length than lateral width, and substantially larger length and width than thickness (measured vertically). The thickness of the spline is preferably sufficient to add structural rigidity and strength to the portions of the top facing sheet 320 intended to receive fasteners. In one embodiment, the stiffening splines 500 may have a rectilinear configuration in top plan view such as a rectangular shape with greater length than width. The stiffening spline 500 is raised above the surface of the top facing sheet 320.

In certain embodiments as illustrated herein, each stiffening spline 500 may have a continuous uninterrupted structure and extends lengthwise (in the same direction as the longitudinal grid support members 202) for a majority of the length of the ceiling panel 300 and central portion 345 of the panel for several reasons. First, the stiffening spline 500 creates a backbone on the top facing sheet 320 so that regardless of where the hangers 400 are mounted on the spline, the spline will stiffen an entire longitudinal area of the facing to prevent excessive sagging of the panel in the central portion 345. Accordingly, the stiffening splines 500 are preferably arranged to extend at least through the central portion 345 of the ceiling panel 300 and its top facing sheet 320. Second, the elongated continuous structure of the stiffening spline 500 allows mounting of the hangers 400 to the spline at a continuum of possible axial positions along the spline's length for greater flexibility in spacing the hangers to best support the size and weight the honeycomb ceiling panel 300 without undue sagging. However, in some embodiments depending on the size and weight of the ceiling panel 300, in other embodiments each stiffening spline 500 may actually be comprised of several short longitudinally aligned and spaced apart segments place only in areas where a hanger 400 will be affixed, thereby forming a non-continuous interrupted linear structure.

In one non-limiting arrangement, each honeycomb ceiling panel 300 may include at least two stiffening splines 500 with multiple longitudinally spaced hangers 400 on each which are hung from two corresponding longitudinal grid support members 202 as shown in FIGS. 1 and 2. The splines 500 and grid support members 202 are arranged in parallel relationship in one embodiment. The dual splines and grid support member arrangement ensures that the ceiling panel 300 will remain stable and level when hung. Additional stiffening splines 500 and grid support members 202 may be added for larger ceiling panels. It should be noted that in some embodiments as illustrated, the stiffening splines 500 need not necessarily extend all the way to the longitudinal peripheral sides 306*a* of the ceiling panels 300, but rather may have terminal ends that are spaced inwards from the sides. In other arrangements, the splines 500 may extend completely from one longitudinal peripheral side 306*a* to the opposite longitudinal peripheral side.

The stiffening splines 500 may have a thickness less than the thickness of the ceiling panels 300, and in some embodiments greater than the thickness of the top facing sheet 320 sheet. In other implementations, the stiffening splines 500 may have a thickness approximately the same as the top facing sheet 320. Stiffening splines 500 may be formed of any suitable sheeting material having a structure sufficient to stiffen the ceiling panel and prevent excessive sagging, including for example without limitation foamed plastic (polymeric foam), non-foamed plastic, fiberglass, wood, metal, composites, non-woven glass, resin impregnated corrugated cardboard, laminated multi-layer kraft paper, or other.

It will be appreciated that in other embodiments, the reinforced sections 502 may alternatively take on other forms. Accordingly in certain embodiments, the reinforced sections 502 may be formed as discrete locally areas on the top facing sheet 320 which are structurally modified in a way to increase the stiffness/rigidity of the facing material; either topically or internal to the structure. For example, the top facing sheet 320 may be infused with a resin or paint of sufficient body to strengthen the treated section and allow for direct attachment of the mounting hardware. The resin or paint in some embodiments may harden after application to stiffen portions of the top facing sheet 320 where added. The pattern and shape of the reinforced sections 502 may generally the same as the stiffening splines 500 described above in top plan view and include longitudinal continuous or discontinuous areas of the top facing. The invention is expressly not limited by the form or structure of the reinforced section 502 so long as the top facing is reinforced, strengthened and stiffened to accept fasteners and prevent excessive sagging of the central portion of the ceiling panel ("pillowing"). Furthermore, the reinforced sections 502 need not be raised in structure above the top facing sheet 320 unlike the stiffening splines 500 shown herein, as in the case for example of impregnating portions of the top facing with resin, paint, or another material. In certain embodiments, the entire top facing sheet 320 may be reinforced to accept fasteners.

Figure 9:
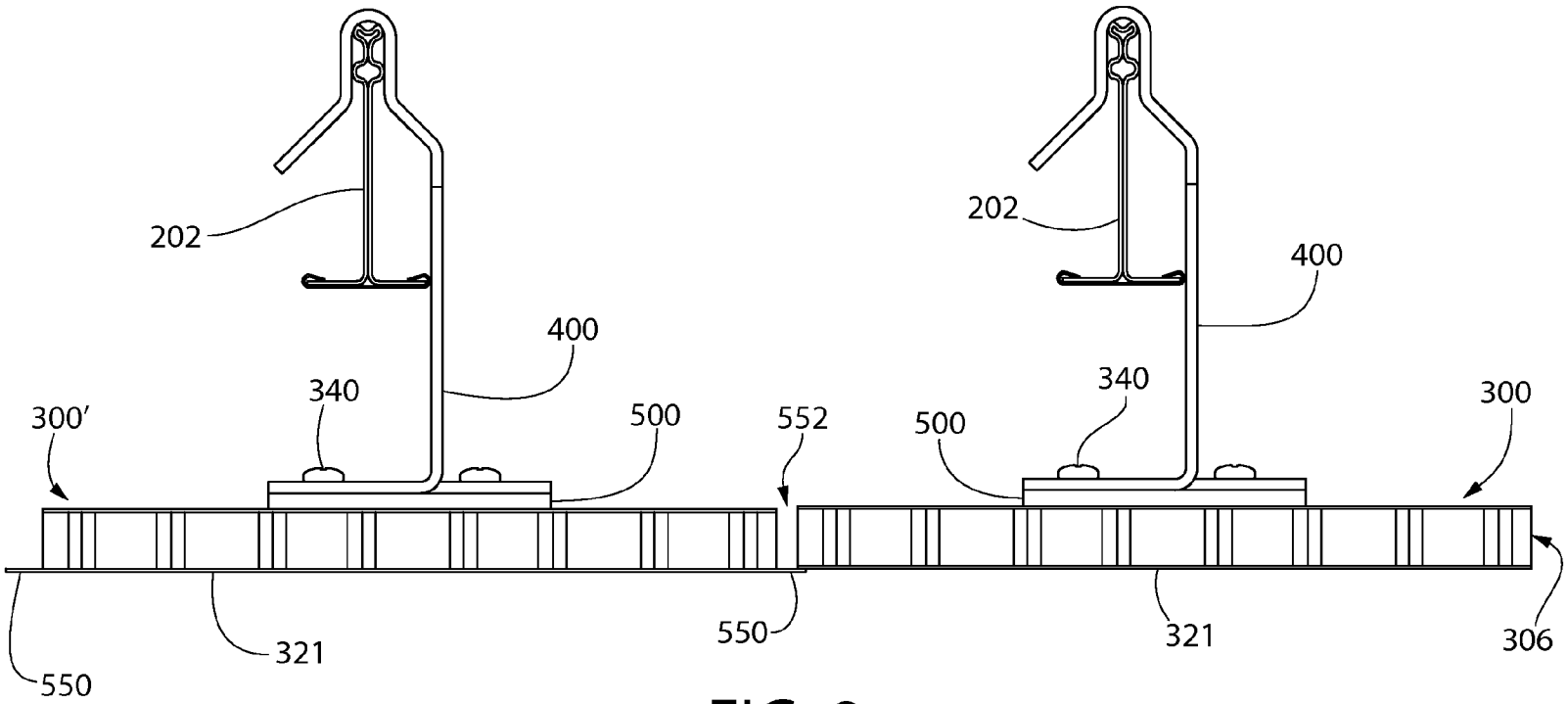
FIG. 9 is an end elevation view of the ceiling system showing a pair of adjoining panels and an alternative bottom facing configuration having concealment flanges overlapping the adjoining non-flanged bottom facing of the second panel.

FIG. 9 depicts an embodiment of a honeycomb ceiling panel 300' having one or more peripheral sides 306 with flange extensions 550 formed on bottom facing sheet 321 which protrude laterally outwards from the panel. The flange extensions 550 are arranged to overlap the bottom facing sheet 321 of an adjoining ceiling panel 300 to conceal the seam 552 formed between the panels. The bottom facing sheet 321 of the adjoining panel 300 does not have flange extensions on the peripheral sides intended to abut flanged peripheral sides of panel 300'. Ceiling panel 300' may be identical to ceiling panel 300 in every other aspect.

A method for supporting a ceiling panel 300 operable to conceal grid support members 202, 204 of a ceiling system 100 will now be described with reference to FIGS. 1-8. In one embodiment, the ceiling panel 300 may be a honeycomb ceiling panel. In this non-limiting exemplary method, the reinforced sections 502 may be configured as stiffening splines 500; however, other forms of reinforced sections could have alternatively been used.

A plurality of honeycomb ceiling panels 300, hangers 400, and threaded fasteners 340 are provided. The stiffening splines 500 are attached to the top facing sheet 320 of each ceiling panel 300 using any suitable means, such as those already described herein. In one embodiment, two stiffening splines 500 are attached to the top facing sheet 320 of each ceiling panel in a horizontally spaced apart manner. The stiffening splines may be attached to the ceiling panel either in the factory preferably for new installations, or alternatively in the field particularly in instances where the ceiling panels will be retrofit to a pre-existing support grid 200. This allows adjustment of the spline locations to match the longitudinal grid support member 202 layout to which the hangers 400 will be attached.

Next, the hangers 400 are attached to the stiffening splines 500 using the fasteners 340. The hangers 400 are longitudinally spaced apart on the splines at appropriate intervals for proper ceiling panel support and stability. Each ceiling panel 300 is now ready for hanging from a suspended support grid.

A plurality of longitudinal grid support members 202 are hung from an overhead ceiling support structure in parallel relationship to each other in the arrangement as shown. The grid support members 202 are horizontally spaced apart by a distance, which in some embodiments may be uniformly spaced inwards from opposing lateral peripheral sides 306*b* by about 20-25% of the lateral width of the ceiling panel.

The tops (e.g. stiffening elements 220) of each grid support member 202 substantially lie in a common horizontal reference plane.

A plurality of lateral grid support members 204 may optionally but preferably be provided and hung from an overhead ceiling support structure in parallel relationship to each other in the arrangement as shown. It will be noted that the ceiling panel 300 and hanger 400 system will provide lateral stability to the longitudinal grid support members 202 after the panels are hung. This may be sufficient in some installations where the span of the longitudinal grid support members is not too great to induce excessive swaying during ceiling panel installation. If provided though, the grid support members 202 are horizontally spaced apart transversely to the longitudinal axis LA between the longitudinal grid support members 202 and are attached thereto at their terminal ends. The lateral grid support members 204 may be oriented orthogonally and perpendicular to the longitudinal grid support members 202 and longitudinal axis LA (see FIGS. 1 and 2). In one embodiment, the bottom flange 210 of each lateral grid support member 204 substantially lies in a common horizontal reference plane with the other grid support members 204 and longitudinal grid support members 202. The bottom surfaces 206 of the grid support members 202, 204 each define a grid face.

The intersecting longitudinal and lateral grid support members 202, 204 define an array of grid openings 208. The grid openings 208 may be rectilinear and are each surrounded by a pair of opposing longitudinally-extending grid faces and a pair of opposing laterally-extending grid faces surface (best shown in FIGS. 2 and 7). In some embodiments, the grid openings 208 may be orthogonal. It should be noted that because the honeycomb ceiling panels 300 do not rely on or interact with the grid openings 208 for mounting but rather may span across several grid openings, the size of the grid openings is unrestricted from a panel mounting standpoint and may be larger than conventional support grid systems.

Referring to FIGS. 1-3, the method continues by now mounting the ceiling tiles in one embodiment. A first ceiling panel 300 is hung from the support grid 200 using a first pair of spaced longitudinal grid support members 202. The panel 300 is first positioned below the support grid by the installers, then raised upwards until the lateral openings 426*a* in the hangers 400 face and are substantially parallel with the grid support members 202. The ceiling panel and hangers then moved laterally/horizontally to insert the grid support members 202 through the lateral openings 426*a*. The ceiling panels 300 are then lowered thereby concomitantly inserting the top stiffening element 220 on each grid support member 202 into the hooked section 406 until it comes to rest on the curved top wall 423 of the hanger 400. The ceiling panels 300 is now hung and fully supported by the grid support members 202. The ceiling panels 300 may then be adjusted longitudinally in a continuum of possible axial positions on the longitudinal grid support members 202 as needed because the hangers 400 remain slideably engaged by the grid support members (see directional arrows, FIG. 3). The large format size of the ceiling panels 300 conceals the support grid 200 and grid support members 202, 204 when viewed from a building space below the ceiling system.

Additional ceiling panels 300 may then be installed in a similar fashion and laterally abutted to adjoining panels (i.e. peripheral edge to peripheral edge) to complete the ceiling system 100. If some of the ceiling panels 300' include flange extensions 550 as shown in FIG. 9 and described herein, the flanges are inserted beneath the non-flanged edges of adjoining panels 300 so as to overlap the bottom facing sheet 321 of the adjoining ceiling panels to conceal the seam 552 formed between them.

As used throughout, any ranges presented herein are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A ceiling system comprising:

an overhead support grid including an elongated longitudinal grid support member;

a honeycomb ceiling panel disposed below the support grid and supported by the grid support members, the ceiling panel including a top facing sheet, a bottom facing sheet, a core comprised of a plurality of cells extending between the top and bottom facing sheets, and a plurality of peripheral sides, the facing sheets adhesively bonded to the core;

the top facing sheet including a longitudinally extending first reinforced section structured to have a greater stiffness than unreinforced portions of the top facing sheet; and a plurality of longitudinally spaced apart hangers arranged in a linear row and attached to the first reinforced section of the top facing sheet, the hangers being configured for removable attachment to the longitudinal grid support member;

the first reinforced section comprising a first stiffening spline attached to the top facing sheet, the first stiffening spline having an elongated flattened plate structure and being disposed between the hangers and top facing sheet;

the first stiffening spline having a continuous length greater than a majority of the length or width of the ceiling panel, wherein the first stiffening spline extends beneath the plurality of hangers in the linear row such that more than one hanger is attached to the first stiffening spline;

wherein the ceiling panel is hung from the longitudinal grid support members via the hangers and conceals the grid support member when viewed from below the bottom facing sheet;

wherein the hangers are slideable along the longitudinal grid support member such that the ceiling panel is longitudinally adjustable in a continuum of axial positions on the longitudinal grid support member.

2. The ceiling system according to claim 1, wherein the first reinforced section is longitudinally elongated in a same direction as the longitudinal grid support member.

3. The ceiling system according to claim 1, wherein the at least one reinforced section comprises less than a total surface area of the top facing sheet.

4. The ceiling system according to claim 1, wherein stiffening spline has thickness less than the thickness of the ceiling panel.

5. The ceiling system according to claim 1, wherein the hangers are attached to the first reinforced section via threaded fasteners.

6. The ceiling system according to claim 1, wherein the ceiling panel includes a central portion disposed between the peripheral sides, the first reinforced section extending through a majority of the central portion.

7. The ceiling system according to claim 1, further comprising:

a second longitudinal grid support member;

a second reinforced section disposed on the top facing sheet of ceiling panel and structured the same as the first reinforced section; and a second plurality of hangers attached to the second reinforced section;

wherein the ceiling panel is mounted to the second longitudinal grid support member via the second plurality of hangers.

8. The ceiling system according to claim 7, wherein the second reinforced section of the ceiling panel is laterally spaced apart from the first reinforced section.

9. The ceiling system according to claim 1, wherein the top facing sheet is vertically spaced apart from and below the longitudinal grid support member.

10. A ceiling system comprising:

a pair of longitudinal grid support members arranged parallel to a longitudinal axis;

a plurality of hangers arranged in first and second linear rows, the hangers being configured and arranged for removable attachment to the longitudinal grid support members;

a ceiling panel each including a top facing sheet, a bottom facing sheet, and a honeycomb core comprised of a plurality of paper cells extending between the top and bottom facing sheets, the top facing sheet having a first major surface opposite a second major surface and the second major surface facing the honeycomb core;

a stiffening spline having a first major surface opposite a second major surface, the stiffening spline being disposed between the hangers and top facing sheet;

wherein each stiffening spline extends beneath the plurality of hangers such that more than one hanger is attached the stiffening spline, and an interface exists between the second major surface of the stiffening spline and the first major surface of the top facing sheet of the ceiling panel;

wherein the ceiling panel is hung from the longitudinal grid support members via the hangers.

11. The ceiling system according to claim 10, wherein the stiffening splines has a greater thickness than the top facing sheet.

12. The ceiling system according to claim 10, wherein the ceiling panel has opposing cantilevered peripheral lateral portions that each extend transversely outwards beyond a respective one of the longitudinal grid support members.

13. The ceiling system according to claim 12, wherein the lateral portions each extend outwards by at least 15% of a width of the panel measured transversely to the longitudinal axis.

14. The ceiling system according to claim 10, wherein the stiffening spline has a substantially uniform thickness.

15. The ceiling system according to claim 10, wherein adhesive is present in the interface.

16. A ceiling system comprising:

a plurality of longitudinal grid support members;

a plurality of hangers removeably attached to the longitudinal grid support members;

a ceiling panel including a top facing sheet, a bottom facing sheet, and a honeycomb core, the honeycomb core comprised of a plurality of paper cells extending between the top and bottom facing sheets;

a stiffening spline attached to the top facing sheet and disposed between the hangers and top facing sheet and more than one hanger is attached to each of the stiffening splines, the stiffening spline having a uniform thickness;

wherein the ceiling panel is hung from the longitudinal grid support members via the hangers.

17. The ceiling system according to claim 16, wherein the stiffening spline is attached to the top facing sheet by adhesive.

18. The ceiling system according to claim 16, wherein the stiffening spline is attached to the top facing sheet by a fastener.

19. The ceiling system according to claim 16, the top facing sheet comprises an upper major surface opposite a lower major surface, wherein the lower major surface faces the honeycomb core;

the stiffening spline comprises an upper major surface opposite a lower major surface; wherein the upper surface of the stiffening spline faces the plurality of hangers; and wherein an interface exists between the upper major surface of the top facing sheet and the lower major surface of the stiffening spline.

20. The ceiling system according to claim 19, wherein adhesive is present in the interface.

* * * * *